US011659896B2

(12) United States Patent
Fuerst, Jr. et al.

(10) Patent No.: US 11,659,896 B2
(45) Date of Patent: May 30, 2023

(54) SYSTEMS AND METHODS FOR AUTOMATIC PRODUCTION OF A CORD STRUCTURE

(71) Applicant: Fuerst Group, Inc., Menlo Park, CA (US)

(72) Inventors: Rory Fuerst, Jr., Portland, OR (US); Shane Dittrich, Nampa, ID (US); Michael A. Aveni, Lake Oswego, OR (US); Kristopher Ryan Okelberry, Nampa, ID (US); Oscar Williamson, III, Nampa, ID (US)

(73) Assignee: Fuerst Group, Inc., Menlo Park, CA (US)

( * ) Notice: Subject to any disclaimer, the term of this patent is extended or adjusted under 35 U.S.C. 154(b) by 267 days.

(21) Appl. No.: 17/002,662

(22) Filed: Aug. 25, 2020

(65) Prior Publication Data

US 2020/0383431 A1 Dec. 10, 2020

Related U.S. Application Data

(62) Division of application No. 15/615,685, filed on Jun. 6, 2017, now Pat. No. 10,791,800.

(Continued)

(51) Int. Cl.

*A43B 1/04* (2022.01)
*A43C 1/04* (2006.01)

(Continued)

(52) U.S. Cl.

CPC ..... *A43D 119/00* (2013.01); *A43B 1/04* (2013.01); *A43B 9/02* (2013.01); *A43B 9/12* (2013.01);

(Continued)

(58) Field of Classification Search

CPC .... A41D 119/00; A41D 2200/10; A43B 1/04; A43B 9/02; A43B 9/12; A43B 23/027;

(Continued)

(56) References Cited

U.S. PATENT DOCUMENTS 4,762,455 A 8/1988 Coughlan et al.
5,845,540 A 12/1998 Rosheim (Continued)

FOREIGN PATENT DOCUMENTS

EP 2649898 A1 10/2013
WO 2008083095 A2 7/2008
WO 2014074928 A1 5/2014

OTHER PUBLICATIONS

Saha, M. et al., "Motion Planning for Robotic Manipulation of Deformable Linear Objects," Proceedings of the 2006 IEEE International Conference on Robotics and Automation (ICRA 2006), May 15, 2006, Orlando, Florida, 8 pages.

(Continued)

*Primary Examiner* — Katharine G Kane
(74) *Attorney, Agent, or Firm* — McCoy Russell LLP

(57) ABSTRACT

Systems and methods for automatically producing a cord structure are provided herein. In one embodiment, a method comprises automatically forming, with at least one robotic arm, a first plurality of loops in a first plane, and automatically forming, with the at least one robotic arm, a second plurality of loops in a second plane orthogonal to the first plane, the second plurality of loops slippably engaged with the first plurality of loops. In this way, cord structures may be quickly constructed, thereby reducing labor input and expense.

16 Claims, 10 Drawing Sheets

Related U.S. Application Data

(60) Provisional application No. 62/346,399, filed on Jun. 6, 2016.

(51) Int. Cl.

| | |
|---|---|
| ***A43B 23/02*** | (2006.01) |
| ***D03D 1/00*** | (2006.01) |
| ***D04B 5/00*** | (2006.01) |
| ***A43D 119/00*** | (2006.01) |
| ***D04B 37/02*** | (2006.01) |
| ***D04B 1/12*** | (2006.01) |
| ***D04B 15/80*** | (2006.01) |
| ***A43B 9/02*** | (2006.01) |
| ***A43B 9/12*** | (2006.01) |
| ***D03D 51/02*** | (2006.01) |

(52) U.S. Cl.

CPC ..... *A43B 23/027* (2013.01); *A43B 23/0295* (2013.01); *A43C 1/04* (2013.01); *D03D 1/00* (2013.01); *D03D 51/02* (2013.01); *D04B 1/126* (2013.01); *D04B 5/00* (2013.01); *D04B 15/80* (2013.01); *D04B 37/02* (2013.01); *A43D 2200/10* (2013.01); *D10B 2501/043* (2013.01)

(58) Field of Classification Search

CPC ... A43B 23/0295; A43B 23/0245; A43C 1/04; D04B 1/126; D04B 15/80; D04B 5/00; D04B 37/02; D10B 2501/043; D03D 1/00; D03D 51/02

See application file for complete search history.

(56) References Cited

U.S. PATENT DOCUMENTS

| | | | | |
|---|---|---|---|---|
| 7,204,042 | B2 | 4/2007 | Aveni | |
| 10,442,086 | B2 | 10/2019 | Chen et al. | |
| 2006/0059715 | A1 | 3/2006 | Aveni | |
| 2010/0107442 | A1 | 5/2010 | Hope et al. | |
| 2011/0041359 | A1 | 2/2011 | Dojan et al. | |
| 2011/0162414 | A1 | 7/2011 | Smith | |
| 2011/0265905 | A1 | 11/2011 | Kühl et al. | |
| 2012/0234052 | A1* | 9/2012 | Huffa | D04B 15/56 66/126 R |
| 2013/0011220 | A1 | 1/2013 | Jacobsen et al. | |
| 2013/0125319 | A1 | 5/2013 | Regan | |
| 2013/0305465 | A1 | 11/2013 | Siegismund | |
| 2013/0340283 | A1 | 12/2013 | Bell et al. | |
| 2014/0130372 | A1 | 5/2014 | Aveni et al. | |
| 2014/0245632 | A1 | 9/2014 | Podhajny et al. | |
| 2014/0373389 | A1 | 12/2014 | Bruce | |
| 2015/0059211 | A1 | 3/2015 | Droege et al. | |
| 2015/0101133 | A1 | 4/2015 | Manz et al. | |
| 2015/0101134 | A1 | 4/2015 | Manz et al. | |
| 2015/0201711 | A1 | 7/2015 | Jurkovic et al. | |
| 2015/0202861 | A1 | 7/2015 | Baggen et al. | |
| 2016/0030134 | A1 | 2/2016 | Shapter et al. | |
| 2016/0206044 | A1 | 7/2016 | Dimoff et al. | |
| 2017/0152614 | A1 | 6/2017 | Hamer et al. | |
| 2017/0156427 | A1 | 6/2017 | Guest et al. | |
| 2017/0157846 | A1 | 6/2017 | Miller et al. | |
| 2017/0188664 | A1 | 7/2017 | Manz et al. | |
| 2017/0202295 | A1 | 7/2017 | MacGilbert et al. | |
| 2017/0202296 | A1 | 7/2017 | Fuerst, Jr. et al. | |
| 2017/0202309 | A1* | 7/2017 | Sterman | A43B 23/0265 |
| 2017/0306539 | A1 | 10/2017 | Gladish et al. | |
| 2017/0320214 | A1 | 11/2017 | Chen et al. | |
| 2018/0103728 | A1 | 4/2018 | Koo | |
| 2018/0195235 | A1 | 7/2018 | Luedecke | |

OTHER PUBLICATIONS

Owano, N., "Robot arm at MIT will weave its own web (w/ Video)," Phys.org Website, Available Online at https://phys.org/news/2012-04-robot-arm-mit-web-video.html, Apr. 29, 2012, 3 pages.

ISA Korean Intellectual Property Office, International Search Report Issued in Application No. PCT/US2017/036222, dated Sep. 13, 2017, WIPO, 3 pages.

ISA Korean Intellectual Property Office, Written Opinion of the International Searching Authority Issued in Application No. PCT/US2017/036222, dated Sep. 13, 2017, WIPO, 10 pages.

European Patent Office, Extended European Search Report Issued in Application No. 17000952.6, dated Nov. 20, 2017, Germany, 7 pages.

* cited by examiner

SYSTEMS AND METHODS FOR AUTOMATIC PRODUCTION OF A CORD STRUCTURE

CROSS REFERENCE TO RELATED APPLICATIONS

The present application is a divisional of U.S. Non-Provisional application Ser. No. 15/615,685, entitled "SYSTEMS AND METHODS FOR AUTOMATIC PRODUCTION OF A CORD STRUCTURE," and filed on Jun. 6, 2017, which claims priority to U.S. Provisional Application No. 62/346,399, entitled "SYSTEMS AND METHODS FOR AUTOMATIC PRODUCTION OF A CORD STRUCTURE," and filed on Jun. 6, 2016.

The entire contents of the above-listed applications are hereby incorporated by reference for all purposes.

BACKGROUND/SUMMARY

Footwear construction typically relies on the manipulation of flat materials into three-dimension shapes in order to form a footwear article. Cloth, leather, or other materials may be cut and sewn or otherwise attached and wrapped around a foot form to create a desired shape for the article, such as a footwear upper. Traditionally, the construction of footwear includes a multitude of steps such as sewing, boning, welding, pressing, knitting, weaving, and so on.

The inventors have recognized several drawbacks with this traditional approach. For example, the steps mentioned above are typically performed manually. While some machines, such as sewing machines, may be used to shorten the production process, footwear construction remains labor-intensive and expensive.

To at least partially address the above issues, the inventors herein have taken alternative approaches to footwear construction. In one example, a footwear article may include a looped upper with fibers or cords formed into a cord structure. The cord structure is automatically constructed by robotic arms. For example, a method for constructing the cord structure includes automatically forming, with at least one robotic arm, a first plurality of loops in a first plane, and automatically forming, with the at least one robotic arm, a second plurality of loops in a second plane orthogonal to the first plane, the second plurality of loops slippably engaged with the first plurality of loops. In this way, a footwear article or another cord structure may be quickly constructed, thereby reducing labor input and expenses.

BRIEF DESCRIPTION OF THE FIGURES

FIG. 1 is shown to scale. However, other relative dimensions may be used if desired.

DETAILED DESCRIPTION

Figure 2:
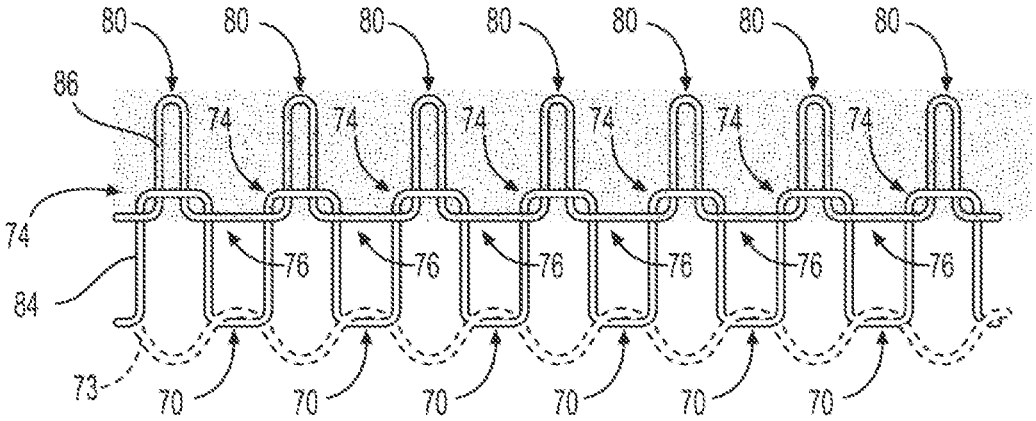
FIG. 2 shows an example intertwined pattern of cords in the footwear article shown in FIG. 1.
Figure 3:
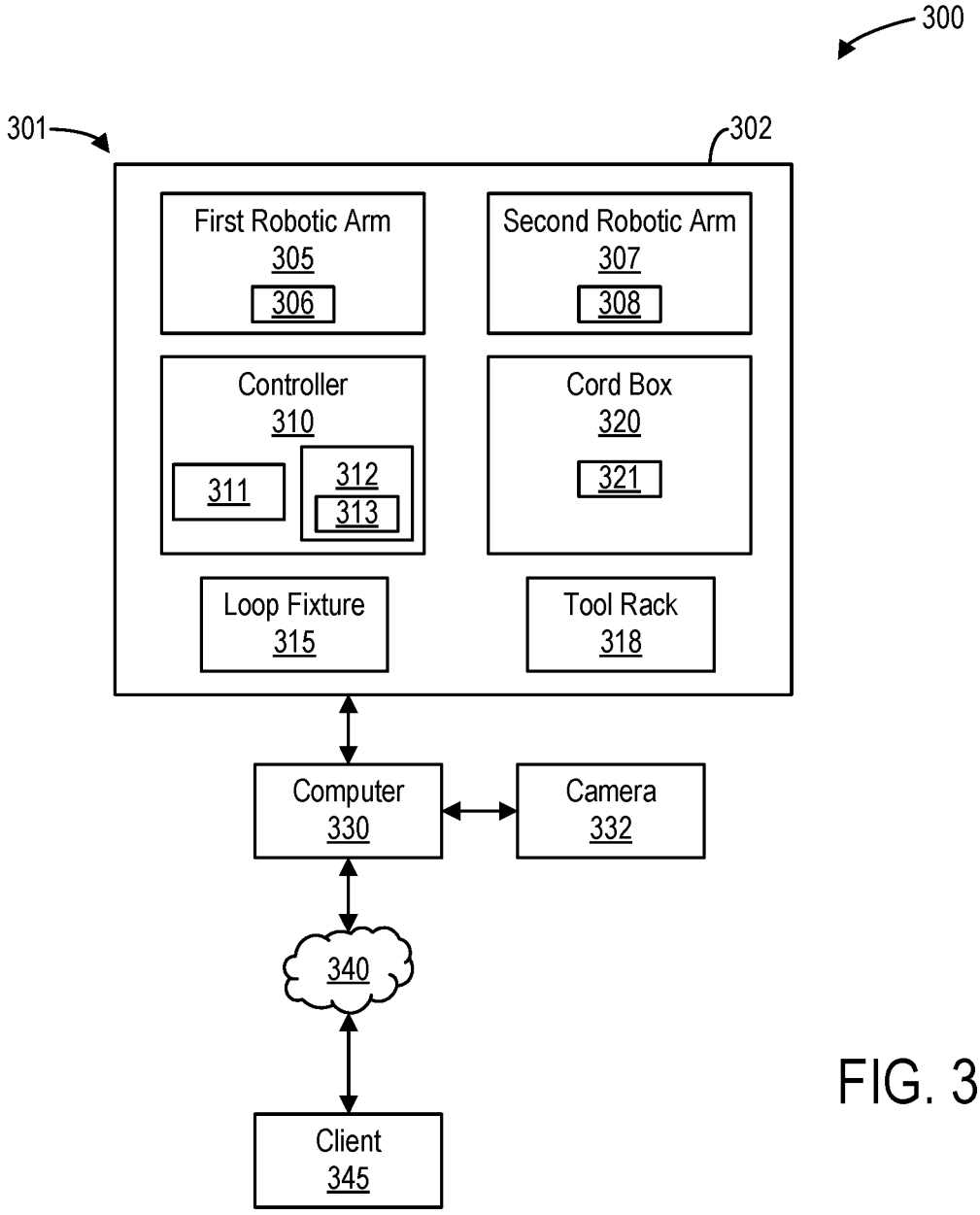
FIG. 3 shows an example system for automatically producing a cord structure.
Figure 9:
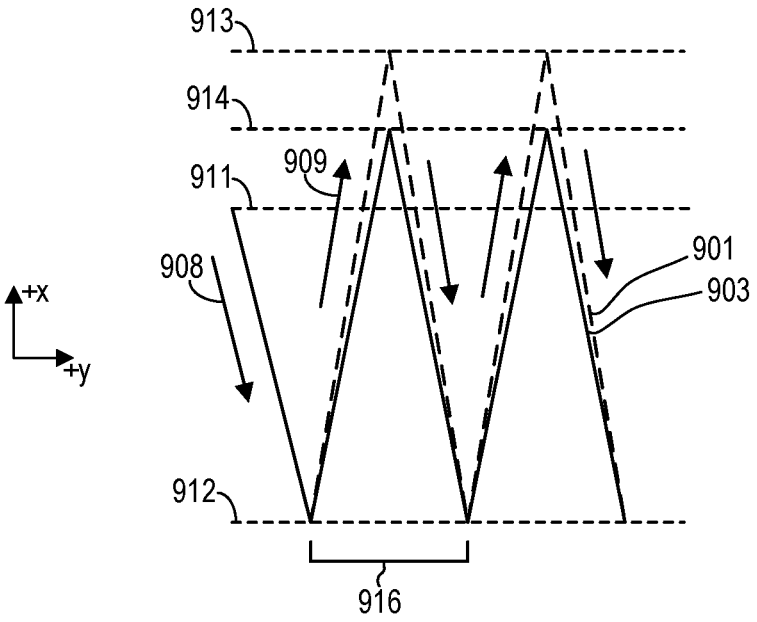
FIG. 9 illustrates an example routine for producing a cord structure.
Figure 10:
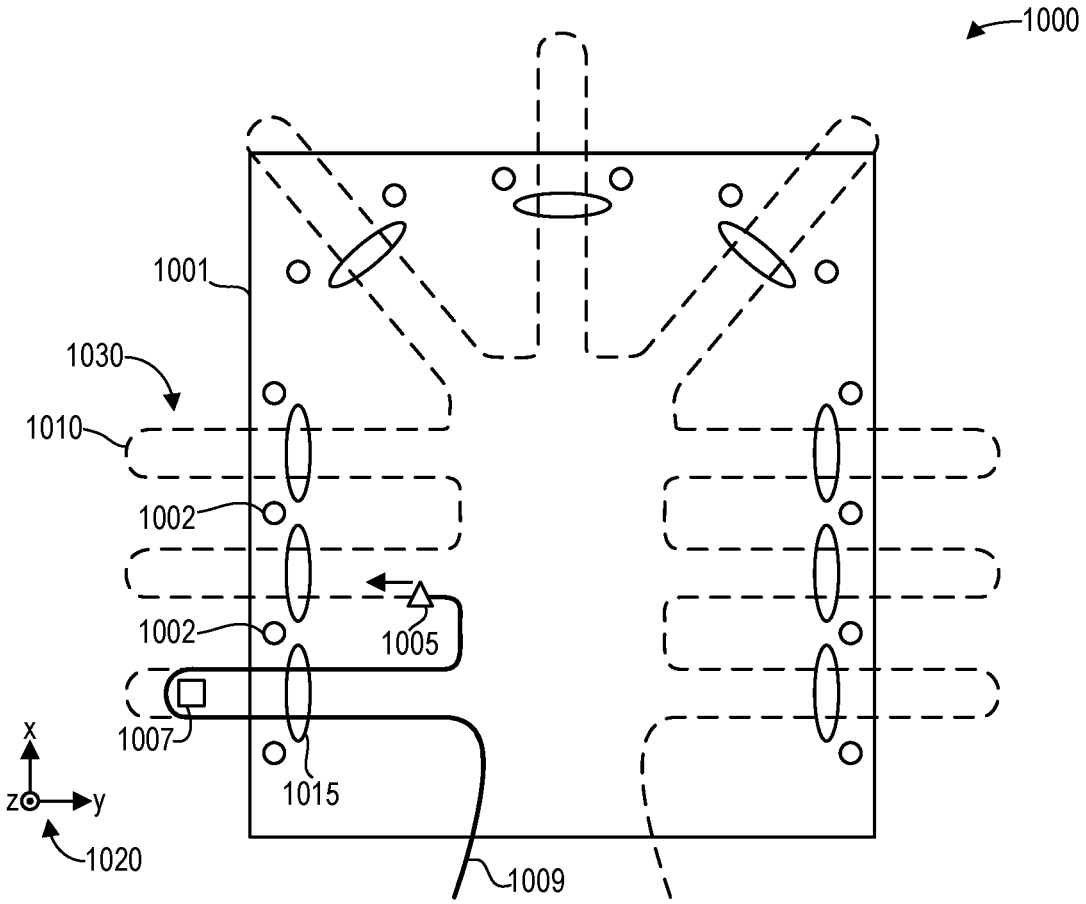
FIG. 10 illustrates construction of a first set of loops in a corded structure.
Figure 11:
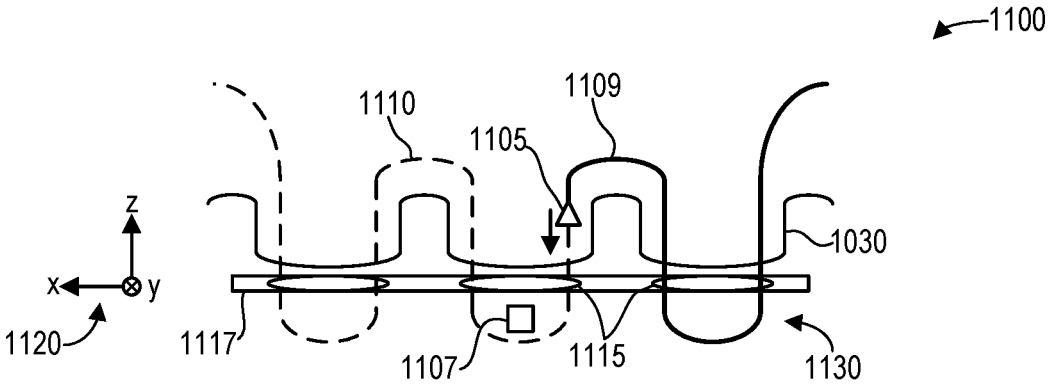
FIG. 11 illustrates construction of a second set of loops through the first set of loops in FIG. 10.

Systems and methods for automatically constructing a cord structure are described herein. Such a cord structure may comprise a corded upper in a footwear article, such as the footwear article depicted in FIG. 1. A cord structure may include interconnected loops of different cords, as depicted in FIG. 2, which form a three-dimensional structure. A system for automatically constructing a cord structure in general or a footwear article in particular is depicted in FIG. 3. Such a system includes a cord structure-building apparatus, such as the apparatus depicted in FIG. 4, which includes at least one robotic arm, such as two or more robotic arms, that automatically weave a cord structure. The cord structure may be at least partially constructed by the robotic arms on a loop fixture, such as the loop fixture depicted in FIG. 5, which includes a plurality of guideposts around and through which loops may be built. Different sets of loops may be constructed from different colored cords, each of which may be threaded through different end-of-arm tools, such as the end of-arm tool depicted in FIG. 6. Such end-of-arm tools are attached to the end of at least one robotic arm, and allow the robotic arm to dispense cord in three-dimensional space to form the cord structure. The cord-building apparatus provides a simplified method for footwear construction, such as the method depicted in FIG. 7. In a method for automatically constructing a cord structure, such as the method depicted in FIG. 8, the cord-building apparatus may create a first set of loops in a first plane, and a second set of loops through the first set of loops in a second plane orthogonal to the first plane. Routines for dispensing cord to create loops are depicted in FIGS. 9-11.

Figure 1:
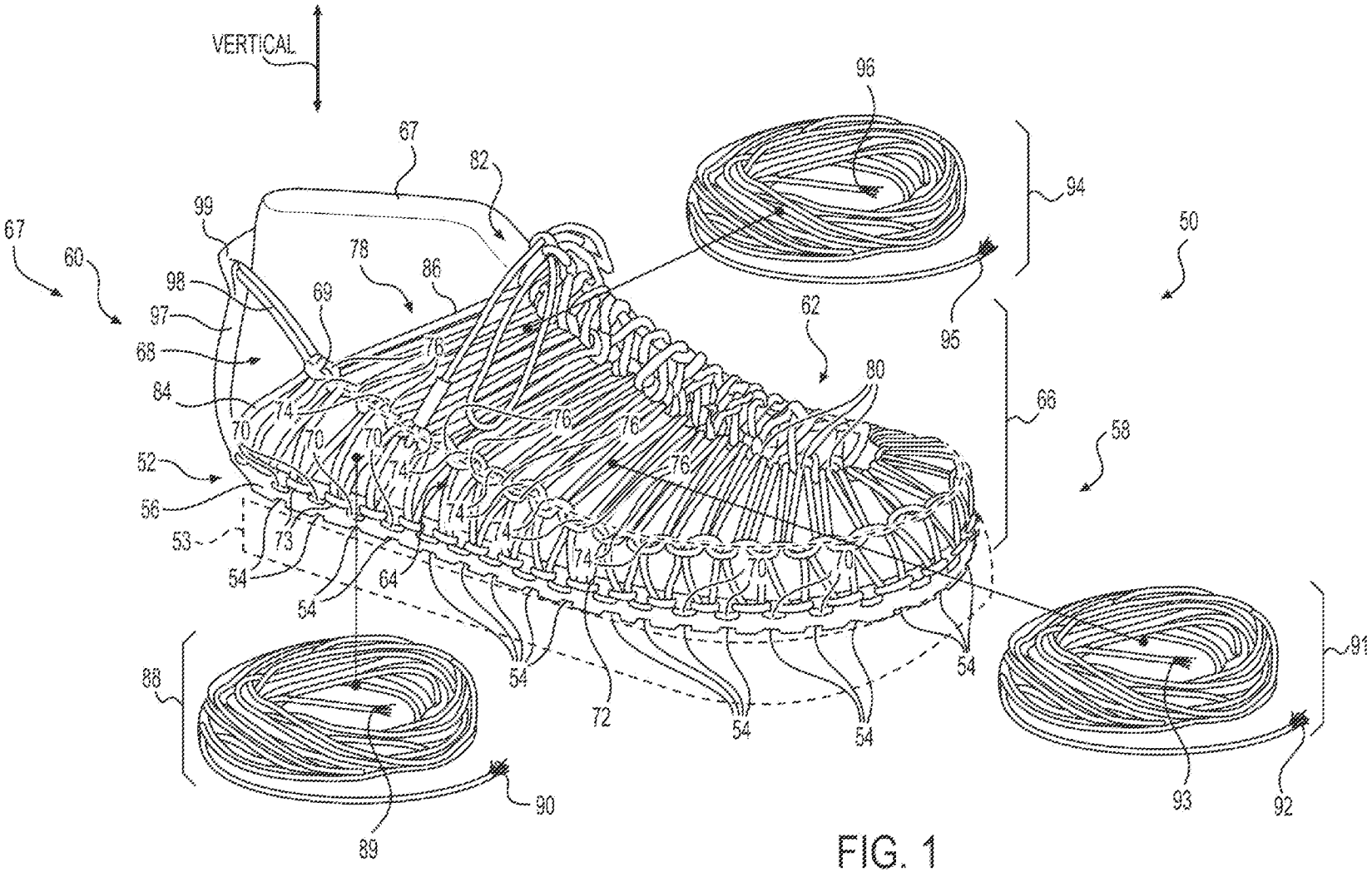
FIG. 1 shows an example of a footwear article.

The footwear article, an example of which is depicted in FIG. 1, may include interconnected bights in a cord structure providing a 3-dimensional form fitting construction. The cord structure increases the range of motion of an upper part of the footwear article while retaining flexibility and comfort. The cord structure may conform highly to the shape of a foot during use due to the relative movement provided by the bights. For example, by providing an array of bight interconnections across the upper from a lateral to medial side, and across a forefoot region, hundreds of adjustments, for example, can be automatically made by the cord structure so that the appropriate lengths of each cord section between the bights are achieved. As a result, the comfort provided by the footwear article is increased.

Further, the cord structure includes an anchor cord positioned away from and parallel to a sole of the footwear article. The remainder of the cord structure may be coupled to the anchor cord through an array of bight connections. In this way, the cord structure can be tensioned independent of other upper materials, thereby enabling a more precise fit and increased functionality of the cord structure. Furthermore, a method for constructing the footwear article is simplified as the cord structure is anchored to the upper rather than directly to the sole.

The example cord structures described herein also enable the manufacturing process of the footwear article to be simplified when compared to other types of shoe construction which use a foot form.

FIG. 1 shows an example footwear article 50. The footwear article 50 may include a sole 52. The sole 52 may be an insole/midsole, in one example. In some examples, the insole and midsole may be single component in the footwear article. However, in other examples, the sole may be a transition material, such as, but not limited to, a cloth-like material that is used during the described production methods to form a portion of the sole or outsole and/or to secure the footwear for formation of the sole or outsole. Further still, in other examples, the insole and midsole may be separate components in the footwear article. Moreover, in one example, the footwear article 50 may also include an outsole. However, in other examples the footwear article 50 may not include an outsole or the outsole may be integrated into the sole 52.

The sole 52 is attached to a cord structure 66. The cord structure 66 is included in an upper 67. The cord structure may be formed from numerous cord sections interlocking with one another. The cord may include string, twine, yarn, rope, cable, strands of braided or twisted materials, and/or other cord-like structures including combinations of the previously listed examples twisted together or otherwise combined. In one example, the cord includes nylon cord of approximately a ⅛" diameter, with an outer sheath and inner twine. Of course, other sizing may also be used. In another example, the cord may be double braided nylon, with an inner braid filling a central void and an outer braid that may be of the same or different material. The cord may be flexible yet retain some of its shape in a free state. Further, the cord may have some elastomeric components. Further, different cord sections (e.g., the vamp as compared to the rand) may have different degrees of flexibility, elasticity, etc. In one example, different materials may be used in different sections of the cord structure 66. For instance, a more flexible type of cord may be used in an upper portion of the cord structure 66 and a less flexible type of cord may be used in a lower portion of the cord structure. Additionally, the portions of the cord structure coupled to the sole may be totally covered via the sole, in one example. In another example, the portions of the cord structure coupled to sole the may only be partially covered. For instance, portions of the cord structure proximate to the toes may be covered while portions of the cord structure, proximate to a heel, may be uncovered or vice-versa. Covering portions of the cord structure reduces the likelihood of premature wear of the cord caused by abrasions from rocks, dirt, and/or other particulates from the external environment. As a result, the footwear article's longevity is increased.

In one example, one or more cords in the cord structure 66 may extend through openings in the sole 52 to facilitate coupling of the sole to the cord structure. Additionally alternatively, a portion of the cord structure may be stitched, adhesively bonded (e.g., glued), and/or snapped into the sole to enable the coupling of the sole and the cord structure. In another example, a plurality of anchor points attached to the cord structure may be fixedly attached (e.g., injection molded into) to the sole. The anchor points may be individual cord loops.

In one example, the cord structure 66 may be a looped upper. In such an example, the looped upper may be formed in a grid-like pattern, but substantially free of knots at a plurality of the slippable interfaces positioned away from the sole 52.

The cord structure 66 may be an upper of the footwear article 50. The cord structure 66 may at least partially enclose a foot. The cord structure 66 includes a rand substructure 68. The rand substructure is coupled to the sole 52. Specifically in one example, sole attachment bights in the rand substructure 68 may be coupled to and/or extend through attachment openings in the sole. In one example, the attachment bights may be formed via a single cord in the rand substructure 68. Thus, a single cord may have multiple bights. A bight is a curved portion or section of a greater cord in the cord structure 66. Thus, a bight may be a portion of a loop in a cord.

The rand substructure 68 further includes vamp attachment bights 74. The vamp attachment bights 74 are coupled (e.g., interconnected, interlocked, stitched, intertwined, and/or slidingly engaged) to rand attachment bights 76 included in a vamp substructure 78 in the cord structure 66. The interconnection between the vamp attachment bights 74 and the rand attachment bights forms a loop line 69. The loop line 69 may be an interface between the rand substructure 68 and the vamp substructure 78. The loop line 69 extends in a direction from a heel side 60 of the footwear article 60 to a toe side 58 of the footwear article. The loop line 69 also extends from a tibular side 62 of the footwear article 50 to a fibular side 64 of the footwear article. The loop line 69 may peripherally extend around the footwear article, and in one example may traverse around the entire upper. Further it will be appreciated that the loop line 69 may extend in an arc around at least a portion of the footwear article 50. Other loop line configurations have been contemplated. For instance, the loop line may extend across the footwear article from a first later side to a second lateral side. Further in another example, the loop line may extend around the footwear article in an arc, from a first side of a heel counter to a second side of a heel counter. Still further in another example, the loop line may laterally extend across the footwear article as well as extend in an arc around a front of the footwear article (e.g., toe side). Even further in another example, the loop line may only extend around a portion of the footwear article, such as a portion adjacent to a toe side or a heel side of the footwear article. Further still in one example, the footwear article may include a plurality of loop lines.

The vamp substructure 78 is spaced away (e.g., vertically spaced away) from the sole 52, in the depicted example. Additionally, the rand substructure 68 may be positioned vertically above the sole 52 and the vamp substructure 78 may be positioned vertically above the rand substructure. A vertical axis is provided for reference. However, it will be appreciated that other footwear article orientations may be used if desired. It will be appreciated that the vamp substructure 78 may be spaced away from the sole 52 when the footwear article is not being worn. The cord structure 66 may retain it shape due to the interconnection between the vamp substructure 78 and the rand substructure 68, along with the internal structure of the cord. Example interconnections are discussed in further detail herein.

FIG. 2 shows a more detailed view of the at least partially sliding interconnection between the vamp attachment bights 74 and the rand attachment bights 76. It will be appreciated that the vamp attachment bights 74 are shown interlocked with rand attachment bights, as depicted in FIG. 2. In this way, the vamp substructure may be coupled to the rand substructure without the use of adhesive, if desired. However, it will be appreciated that in some examples adhesives may be used to couple certain elements in the footwear article. In one example, the sliding connection between the bights may be free of knots. However in another example, at least a portion of the vamp attachment bights 74 may be fixedly coupled to at least a portion of the rand attachment bights 76. In another example, stitched locks may be used to provide the partially sliding interconnection. For instance, loose or tight stitched interfaces may be provided at the junctions of the cords in the upper. By controlling the amount of slippable engagement in various sections of the footwear article desired fitting characteristics may be achieved to increase the wearer's comfort. The systems and methods further described herein with regard to FIGS. 3-15 may be directed to forming a cord structure including the vamp and rand substructures depicted in FIG. 2.

It should be appreciated that the cord structure depicted in FIGS. 1 and 2 includes a first loop of the first plurality of loops (e.g., the rand substructure) is intertwined with and slidably movable relative to at least two loops of the second plurality of loops (e.g., the vamp substructure), and a second loop of the at least two loops is intertwined with and slidably movable relative to at least two loops of the first plurality of loops including the first loop. Such a loop configuration enables the slippably engaged and durable cord structure depicted in FIGS. 1 and 2.

Returning to FIG. 1, the vamp substructure 78 further includes lace attachment bights 80. The lace attachment bights 80 are shown coupled to a lace cord 82 in FIG. 1. Specifically, the lace cord 82 extends through the lace attachment bights 80. The length of the lace cord 82 may be adjusted by the wearer. However, alternate lace cord configurations have been considered. For instance, the footwear article may be constructed without a lace cord. In this way, a wearer can quickly and easily slip on and off the footwear article without the need to tie a lace cord. In such an example, elastic material may be provided in the footwear article to enable controlled expansion and contraction of portions of the cord structure. Additionally, different lacing patterns have been considered. For instance, the cord structure may include eyestays. Cords in the cord structure may extend through the eyestays.

The lace cord 82 may be included in the cord structure 66, in some examples. However, in other examples the lace cord 82 may not be included in the cord structure 66. In such an example, elastic or other suitable material may be used to provide the footwear article with a slip-on capability.

Numerous relative vamp cord, rand cord, and/or lace cord lengths have been contemplated. Portions of the rand cord 84 and the vamp cord 86 are also shown in FIG. 2. The sole attachment bights 70 are also shown in FIG. 2. As illustrated, the sole cord 73 (also referred to herein as the anchor cord) is intertwined with the sole attachment bights 70.

It should be appreciated, that the construction method described herein enables, in some embodiments, options for customizing sizing and for adjusting sizing with minimal tooling expenditures. For example, the construction of the upper based on a cord length enables variation in size without changing the upper pattern or obtaining different size cutting dies. As such, in some embodiments, the size of the upper can be altered by varying the cord length. The loops may remain in their relative position for each size. Such construction reduces costs by utilizing same size tooling.

Likewise, customization of the footwear may be applied to improve fit for a specific user. With generation of an electronic scan of a foot, a customized and personalized cord may be used to generate customized footwear based on the foot scan. For example, the lengthening (or shortening) of the loops, the positioning and sizing of the loop line, and the adjustment of cord size may be adjusted alone or in combination to tailor the upper to the specific dimensions of the scanned foot to provide a customized fit.

Turning back to FIG. 1, the rand cord 84 and the vamp cord 86 are depicted as being round cords in FIG. 1. However, other shapes have been contemplated. For instance, one or more of the cords may be flat cords or one or more of the cords may have flat ends and round midsections. In another example, one or more of the cords may have one or more flat sections and one or more round sections. For instance, a cord may include a round section followed by a flat section and so on and so forth. Additionally, the sole cord 73 may be flat, round, or have different sections with varying geometries. Additionally, the rand cord 84, the vamp cord 86, and the lace cord 82 are all depicted as having a similar cross-sectional area (e.g., diameter) and/or geometry. In one example, the diameter of one or more of the cords may be between $1/8^{th}$ of an inch and $1/16^{th}$ of an inch. However, in other examples the cords may have varying widths. It will be appreciated that the sole cord 73 may have a similar geometry to the rand cord, vamp cord, and/or lace cord, in one example. However, in other examples, the cross-sectional area and/or geometry of the rand cord 84, the vamp cord 86, sole cord 73, and/or lace cord 82 may vary. For example, the cross-sectional area of the rand cord may be larger than the vamp cord. In another example, the rand cord may be circular and the vamp cord may be flat.

Further in some examples, the rand cord 84, vamp cord 86, and/or lace cord 82 may comprise similar material(s). However, in other examples the aforementioned cords may comprise different materials. One or more of the cords may comprise synthetic fibers such as Polypropylene, Nylon, Polyester, Polyethylene, Aramid, and/or Acrylate polymer. Additionally, one or more of the cords may comprise natural fibers such as cotton, linen, coir, etc. Further in one example, one or more of the cords may comprise a polymeric material.

Additionally, the rand cord 84, vamp cord 86, and/or lace cord 82 may be designed with different material properties to enable the footwear article have desired structural characteristics. For example, the lace cord 82 may have a greater elasticity than the rand cord 84 and/or the vamp cord 86.

As shown in FIG. 1, the vertical height of the vamp attachment bights increases in a reward direction extending toward the heel side 60 of the footwear article 50. The width of the interlocked vamp cord sections extending from the lace cord to the rand cord may also increase in the reward direction extending toward the heel side 60 of the footwear article 50.

The footwear article 50 also includes a heel counter 97. The heel counter or other support structures in the footwear article may be included in the upper discussed above. It will be appreciated that the rigidity/flexibility of the heel counter 97 may be selected to provide a desired amount of support to the cord structure 66. Specifically, the heel counter 97 may prevent the cord structure from flexing outward and/or downward in a direction toward the sole by an undesirable amount. In this way, the cord structure may maintain a desired shape. As a result, a wearer of the footwear article may quickly and comfortably put on and take off the footwear article. The heel counter 97 may comprise a different material than the cord structure 66, such as leather, synthetic leather, fabric, etc. However, in some examples the heat support structure may also comprise cord. The loop line 69 may extend through the heel counter 97 in some examples. Additionally, the heel counter 97 may be coupled to the sole 52. Specifically, in some examples the heel counter structure may extend (e.g., vertically or angularly) from the sole 52. The heel counter 97 is coupled to the rand substructure 68, in the depicted example. A connection cord 98 is shown extending through bights in the rand substructure 68 and through an opening 99 in the heel counter 97. In this way, the heel counter 97 provides support to the cord structure as well as shields a portion of the cord structure from the external environment.

Additionally or alternatively, the heel counter 97 may be coupled to the vamp substructure 78, thereby providing support to the substructure. The heel counter may have a greater rigidity than the cord structure 66. In one example, the connection cord 98 may be a portion of the vamp cord 86 or the rand cord 84. Additionally, a portion of the cord structure extends around the width of the heel counter 97. However, other heel counter configurations have been contemplated. In one example, ends of cords in the cord structure may be coupled to the heel counter and/or coupled to one another within the heel counter. In one example, the heel counter 97 may have greater stiffness in a longitudinal direction than a lateral direction. The vertical stiffening of the support may provide a desired amount of support to the cord structure. However, other heel counter 97 material characteristics have been contemplated.

The footwear article 50 shown in FIG. 1 may further include an eyestay (not shown). Cords in the cord structure 66 may extend through the eyestay. It will be appreciated that more than one cord section extends though the eyestay, in the depicted example. However in other examples, alternate eyestay designs have been contemplated. The eyestay may provide desired cord spacing and cord support to the cord structure. In this way, the eyestay may limit the free movement of the cords extending therethrough. The eyestay may be included in an upper structure. In one example, the upper structure may be adjacent to a tongue of the footwear article. The upper structure may comprise a different material than the cord structure, in one example. Example eyestay materials include cloth, leather, synthetic leather, fabric, polymeric material, etc. In other examples, the footwear article may include a plurality of eyestays.

Additionally, one or more sheaths may enclose (e.g., circumferentially enclose) a portion of at least one of the rand cord 84 and vamp cord 86, in some examples. Therefore, the sheaths may surround various sections of the cords in the cord structure. For instance, a plurality of sheaths may surround a portion of the rand cord 84 from vamp attachment bights 74 to the rand attachment bights 76. Thus, the sheaths may act as protective covers for the cords. In some examples, the sheath may be in face sharing contact with an outer surface of the cord. However, in other examples, the sheath may be spaced away from an outer surface of the cord. The sheaths may be cylindrical, in one example. However, other sheath geometries have been contemplated. Additionally, a plurality of sheaths may be used to form a toe cap around the toe side of the footwear article. The sheaths may provide increased structural integrity to desired areas of the cord structure 66, to enable the cord structure 66 to retain a desired shape. The sheaths may comprise a different material than the vamp cord and/or the rand cord. In one example, the sheaths may comprise a polymeric material. The sheaths may also protect the cords from damage.

The footwear article may be manufactured using a double lasted strobel and string construction, which allows the various upper parts—the cord structure and the upper structures—to act independent of each other. These upper parts are integrated together by the laces at the lace attachment bights.

FIG. 3 shows a block diagram illustrating an example automated system 300 for automatically producing a cord structure for a footwear article, such as the footwear article described herein above with regard to FIGS. 1-2, or other articles including a cord structure. Automated system 300 includes a cord-building apparatus 301 configured to automatically construct a cord structure. Cord-building apparatus 301 includes a first robotic arm 305 equipped with a first end-of-arm tool 306, a second robotic arm 307 equipped with a second end-of-arm tool 308, a controller 310, and a loop fixture 315. Although described as a first and second robotic arm, it should be appreciated that there may be a single robot, or two, three or more robots/robotic arms. The example is provided for illustration purpose and not as a limitation.

The robotic arms 305 and 307 may comprise, as non-limiting examples, programmable articulated mechanical arms which may be rotationally and translationally displaced. Robotic arms 305 and 307 may include one or more joints that enable the robotic arm to perform tasks. In some examples, the robotic arms are articulated robots and thus include two or more joints.

Figure 4:
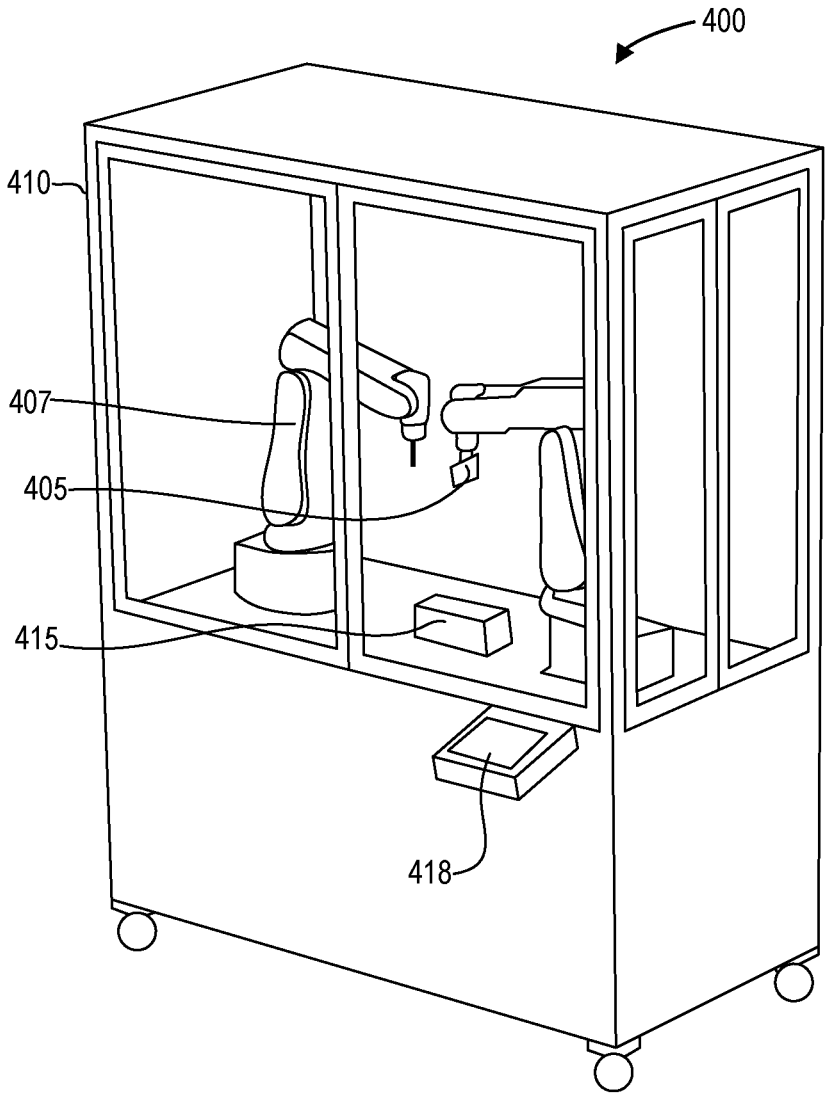
FIG. 4 shows an example apparatus for automatically producing a cord structure.

The components of the cord-building apparatus 301, such as the robotic arms 305 and 307, may be housed within a housing 302. The housing 302 may be partially constructed of glass or another transparent material to allow observation of the robotic arms 305 and 307. As a non-limiting example, FIG. 4 shows a pictorial view of an example apparatus 400. Apparatus 400 includes a first robotic arm 405 and a second robotic arm 407 housed within housing 410. As depicted, housing 410 is partially transparent to enable observation of the construction of a cord structure, and further includes doors to allow access to the components of apparatus 400 within the housing 410.

The first end-of-arm tool 306 of the first robotic arm 305 may comprise a needle threaded with a cord 321 or other fiber, and may be configured to dispense the cord 321 through the needle. The first end-of-arm tool 306 may comprise a device configured to dispense or push the cord through the end of the needle as the first end-of-arm tool 306 is moved by the first robotic arm 305 along a predetermined path, as discussed further herein. An example first end-of-arm tool 306 is described further herein with regard to FIG. 6. The second end-of-arm tool 308 of the second robotic arm 307 may comprise a solenoid or another appropriate device which when actuated may grab, hold, pinch, or otherwise engage a portion of the cord 321. The two robotic arms 305 and 307 may thus assist each other in constructing a cord structure, as described further herein.

Although described in accordance with an exemplary embodiment, in a second embodiment, both robotic arms may actively thread at the same time. The active threading of both robotic arms may function such that both robotic arms thread and hold the cord. As such, although described in some examples with a single robotic arm actively threading, it should be understood that there may be two (or more) actively threading arms.

The cord-building apparatus 301 may further include a controller 310 communicatively coupled to the robotic arms 305 and 307 and configured with executable instructions 313 in non-transitory memory 312 that when executed cause the controller to perform various actions. To that end, the controller 310 comprises a processor 311 as well as a non-transitory memory 312. An example method for controller 310 is described further herein with regard to FIG. 9. Further, the controller 310 may include a user interface (e.g., user interface 418 shown in FIG. 4) to receive inputs (via, as non-limiting examples, a keyboard, touch screen, mouse, joystick, and so on) and display outputs (via, as a nonlimiting example, a display or a touch screen device).

It should be appreciated that while controller 310 is depicted as a single entity, in some embodiments, the controller 310 may comprise a plurality of controllers. As an illustrative and non-limiting example, the controller 310 may include a controller for each robotic arm, and a central controller for coordinating the separate robotic arm controllers.

Cord-building apparatus 301 may include a loop fixture 315 which provides a template or guideposts upon or through which the robotic arms 305 and 307 may construct a cord structure. In embodiments directed towards the construction of a footwear article such as the footwear article described herein above with regard to FIGS. 1-2, the loop fixture 315 may be configured to receive a sole and/or an eyestay to or through which the cord structure may be looped. Further, loop fixture 315 may comprise a left loop fixture and a right loop fixture (i.e., a loop fixture for constructing left-foot footwear articles and a loop fixture for constructing right-foot footwear articles, respectively). In some examples, loop fixture 315 may be adaptable or configured for a plurality of footwear article sizes. However, in other examples, separate loop fixtures for different sizes may be included.

Figure 5:
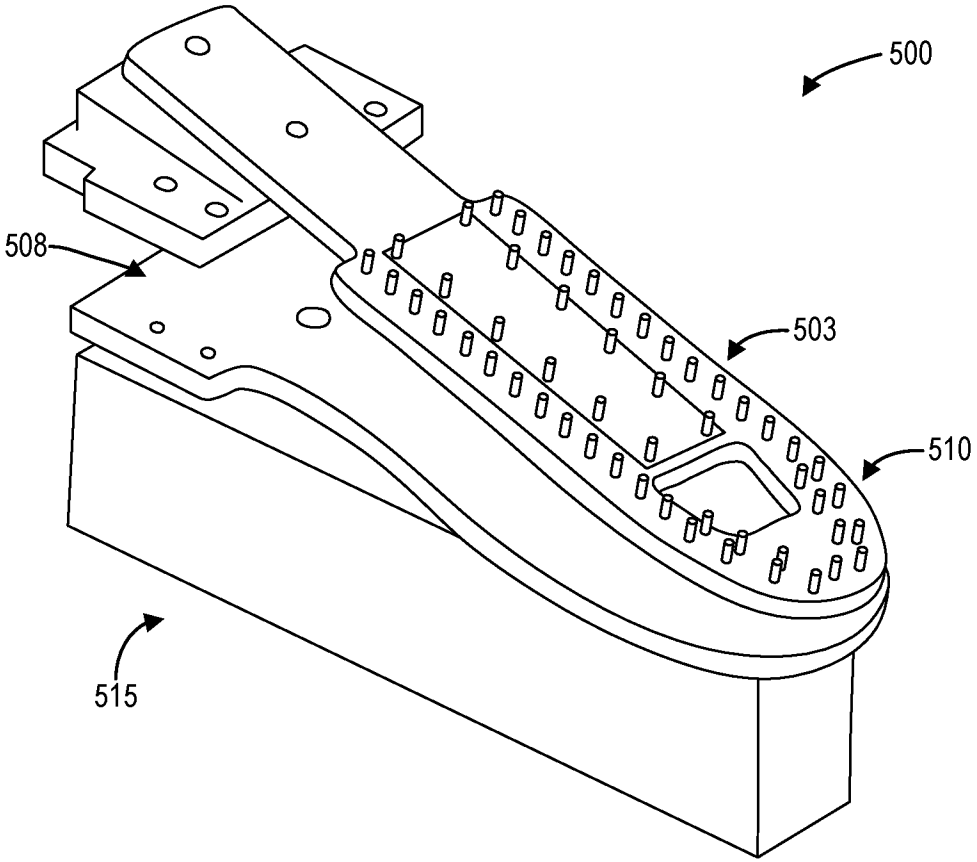
FIG. 5 shows an example loop fixture.

FIG. 5 shows an example loop fixture 500. In some examples, the loop fixture is pre-assembled with an eyestay (not shown) and a sole (not shown). The sole may be inserted into a gap 508 within the loop fixture 500, while the eyestay may be placed upon the top 503 of the loop fixture 500. As depicted, the loop fixture 500 includes a plurality of guideposts 510 around and through which the robotic arms may create loops of a cord structure. Further, the loop fixture 500 includes a mounting structure 515 that allows the loop fixture 500 to be securely fixed within the cord-building apparatus 300.

In some examples, the apparatus may include a left loop fixture and a right loop fixture, corresponding to left and right footwear articles. The loop fixture is used to weave the cord to the correct length. The loop fixture also holds the entire footwear article together during construction.

Referring again to FIG. 3, the loop fixture 315 may be positioned between the first robotic arm 305 and the second robotic arm 307 within the apparatus 301. Such a configuration is illustrated in FIG. 4, wherein loop fixture 415 is mounted on a surface upon which the robotic arms 405 and 407 are also mounted. It should be appreciated that the relative positions of the robotic arms 405 and 407 to the loop fixture 315 are not limited to the exemplary embodiments illustrated and described herein.

Cord-building apparatus 301 may further include an end-of-arm tool rack 318 which stores a plurality of end-of-arm tools for the first robotic arm. For example, end-of arm tool rack 318 may include a plurality of end-of-arm tools, each end-of-arm tool threaded with a different color and/or sized cord. The first robotic arm 305 may automatically select an end-of-arm tool 306 from the end-of-arm tool rack 318 based on a color and/or size request, as described further herein. The end-of-arm tool rack 318 may be positioned, as an example, within the housing 410 of the cord-building apparatus 400 so that the end-of-arm tools stored on the end-of-arm tool rack 318 are accessible to the first robotic arm 405, which may select a selected end-of-arm tool from the end-of-arm tool rack 318 based on a selected color and/or loop size.

Figure 6:
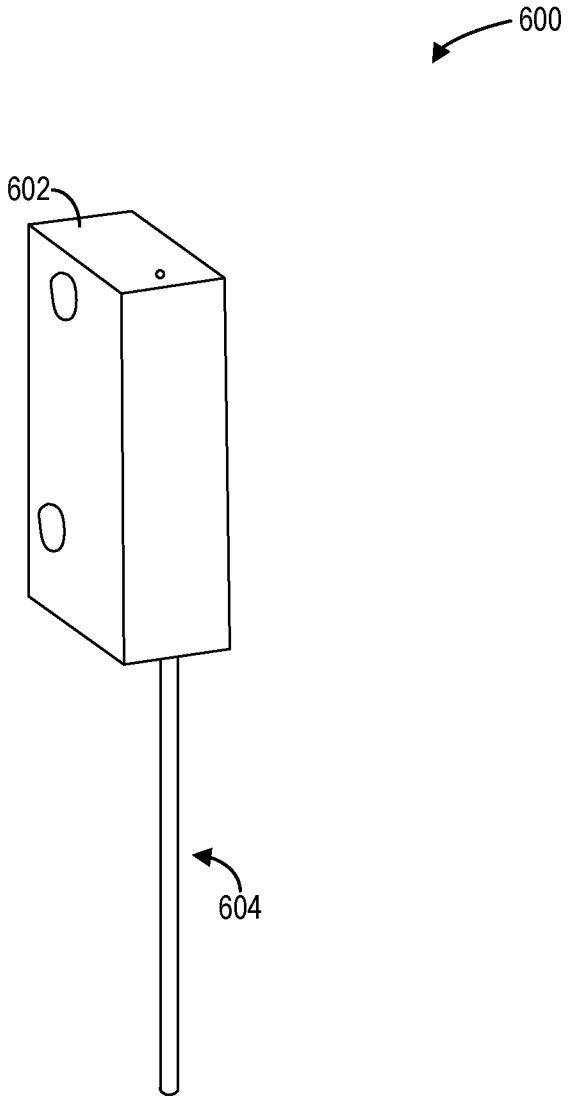
FIG. 6 shows an example end-of-arm tool for dispensing cord.

FIG. 6 shows an example end-of-arm tool 600. An end-of-arm tool rack may hold a plurality of end-of-arm tools, including top end-of-arm tools and bottom end-of-arm tools. If the footwear article is to be constructed with a different color top and bottom loop (e.g., first and second pluralities of loops), the robotic arm will automatically select the correct end-of-arm tool from the end-of-arm tool rack and assemble the footwear article.

The end-of-arm tool 600 may comprise a device 602 configured to dispense a cord. To that end, the end-of-arm tool 600 may further comprise a needle 604 fixedly coupled to the device 602 and configured to precisely dispense the cord at a selected position. The cord (not shown) may be threaded into the device 602 and through the needle 604. The cord may be spooled, for example, away from the device 602, which pulls and/or pushes the cord away from the cord spool or box (not shown) and into the needle 604. The cord may be selectively and automatically dispensed through the end of the needle 604. In some examples, the device 602 may include a cord cutting device (not shown) therein which is configured to cut and therefore released the dispensed cord from the end-of-arm tool 600.

Referring again to FIG. 3, the different cords 321 mentioned above may be stored in separate cord boxes 320. In some examples, the cord box 320 may be external to the cord-building apparatus 301. However, in other examples, the cord box 320 may be positioned within the cord-building apparatus 301.

In some examples, an apparatus for automatically producing a cord structure may include a plurality of cord boxes. The apparatus may include the cord-building apparatus 400, comprising a first robotic arm 405 and second robotic arm 407 housed within a housing 410, a loop fixture 415, and an end-of-arm tool rack 420. The apparatus may further include a box rack storing a plurality of cord boxes. Each cord box may house cord of a particular color. In some examples, the cord in each of the boxes may be threaded to a corresponding end-of-arm tool in the end-of-arm tool rack. In other examples, an operator of the apparatus may manually obtain cord 321 from a cord box 320 and thread an end-of-arm tool in the end-of-arm tool rack 318. While the cord boxes 320 may be positioned external to the housing 410 of the cord-building apparatus, in some examples one or more of the cord boxes 320 are also housed within the housing 410.

Referring again to FIG. 3, the system 300 may further include a computer 330 communicatively coupled to the cord-building apparatus 301. In some embodiments, the computer 330 may be communicatively coupled to an optional camera 332 configured to capture video of the cord structure construction process carried out by the cord-building apparatus 301. The computer 330 may be optionally configured to transmit the video captured by the camera 332 to a client computer 345 via a network 340, such as the public Internet.

Further, the computer 330 may be configured to receive a custom order from the client computer 345 via the network 340, and may communicate the custom order to the cord-building apparatus 301. The custom order may include one or more desired colors, a desired size, and a desired product. Upon receiving the custom order, the cord-building apparatus 301 may automatically construct the ordered product in accordance with the one or more desired colors, desired size, and desired product. In embodiments including the optional camera 332, the camera 332 may capture video of the entire process, which may be streamed back to the client computer 345. In this way, the customer may watch, via a display device of the client computer 345, the video stream of the custom order being prepared. Since the construction process of the footwear article as carried out by the cordbuilding apparatus 301 is brief (e.g., in some examples, the process may be completed in approximately ten minutes or less) compared to conventional footwear article construction methods, the customer may view the construction and know that the order is being correctly fulfilled.

Figure 7:
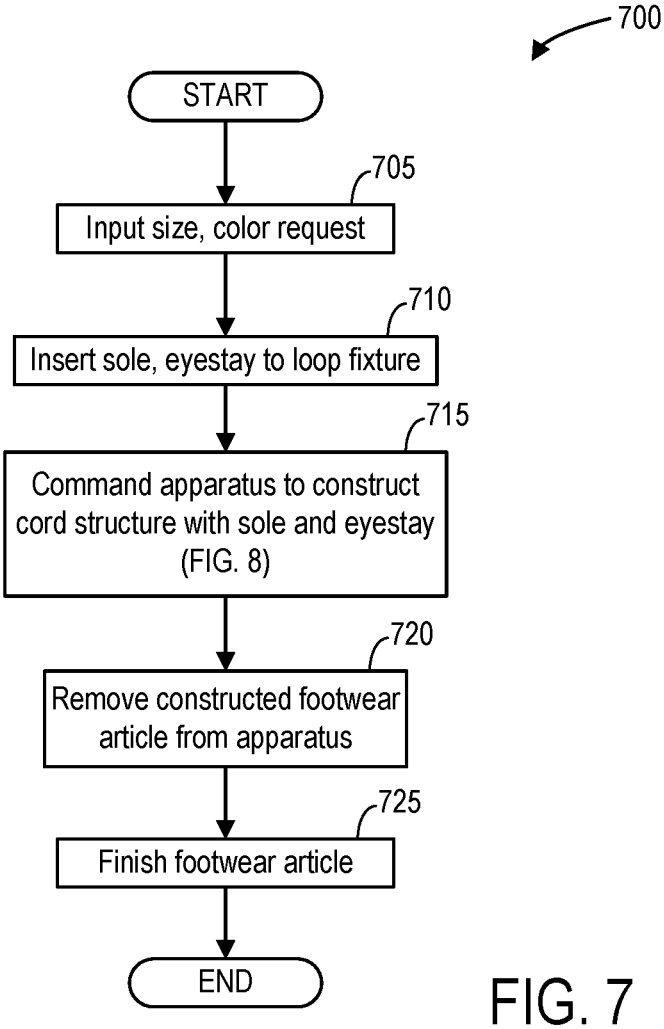
FIG. 7 shows a high-level flow chart illustrating an example method for automatically producing a footwear article with a cord structure.

FIG. 7 shows a high-level flow chart illustrating an example method 700 for automatically producing a footwear article with a cord structure. Method 700 will be described with reference to the systems and components of FIGS. 3-6, though it should be appreciated that the method may be implemented with other systems and components without departing from the scope of the present disclosure.

Method 700 begins at 705. At 705, method 700 includes inputting a size and a color request to a cord-building apparatus, such as cord-building apparatus 301 or 400 described herein above. In some examples, an operator may use a user interface device (e.g., the user interface 418) to input one or more selected cord colors, and the operator may further select a desired size of the product. In other examples, the size and color request may be electronically transmitted to the cord-building apparatus, for example via a computer communicatively coupled to the cord-building apparatus.

At 710, method 700 includes inserting a sole and an eyestay to the loop fixture. In some examples, an operator may pre-assemble the eyestay and the sole onto the loop fixture assembly, and then load the pre-assembled loop fixture assembly into the apparatus. In other examples, a robotic arm may automatically insert a sole and an eyestay to the loop fixture within the cord-building apparatus.

At 715, method 700 includes commanding the apparatus to automatically construct the cord structure of the upper. In some embodiments, commanding the apparatus to construct the cord structure may comprise initiating a method implemented in the apparatus. An example of such a method is described further herein with regard to FIG. 8. Commanding the apparatus to initiate or execute such a method may comprise an operator pressing a "Start" button positioned at the apparatus, for example on touch screen interface.

The apparatus may then automatically weave a plurality of loops through the eyestay and the sole to create a cord structure comprising an upper. The cord structure coupled to the eyestay and the sole comprise a footwear article. The footwear article may comprise, for example, the footwear article of FIG. 1, while the cord structure comprising the upper may comprise the cord structure depicted in FIGS. 1 and 2.

After the cord-building apparatus completes the automatic construction of the cord structure, method 700 proceeds to 720. At 720, method 700 includes removing the constructed footwear article from the apparatus. For example, an operator may remove the loop fixture from the cord-building apparatus, and then remove the constructed footwear article (comprising the sole, eyestay, and cord structure) from the loop fixture.

At 725, method 700 includes finishing the footwear article. Finishing the footwear article may include attaching an anchor cord to the cord structure, for example through the loops extending below the sole. Finishing the footwear article may further include trimming and securing the cord structure, adding different components (e.g., insole, heel counter, toe cap, lacing system, and so on) to the constructed footwear article, and any other step to finalize the footwear article for use. In some examples, the footwear article may be automatically finished by the cord-building apparatus prior to removing the footwear article from the apparatus. For example, at least one robotic arm may be commanded to automatically attach the anchor cord the cord structure. Method 700 then ends. Method 700 may be repeated to construct a left footwear article and a right footwear article.

Figure 8:
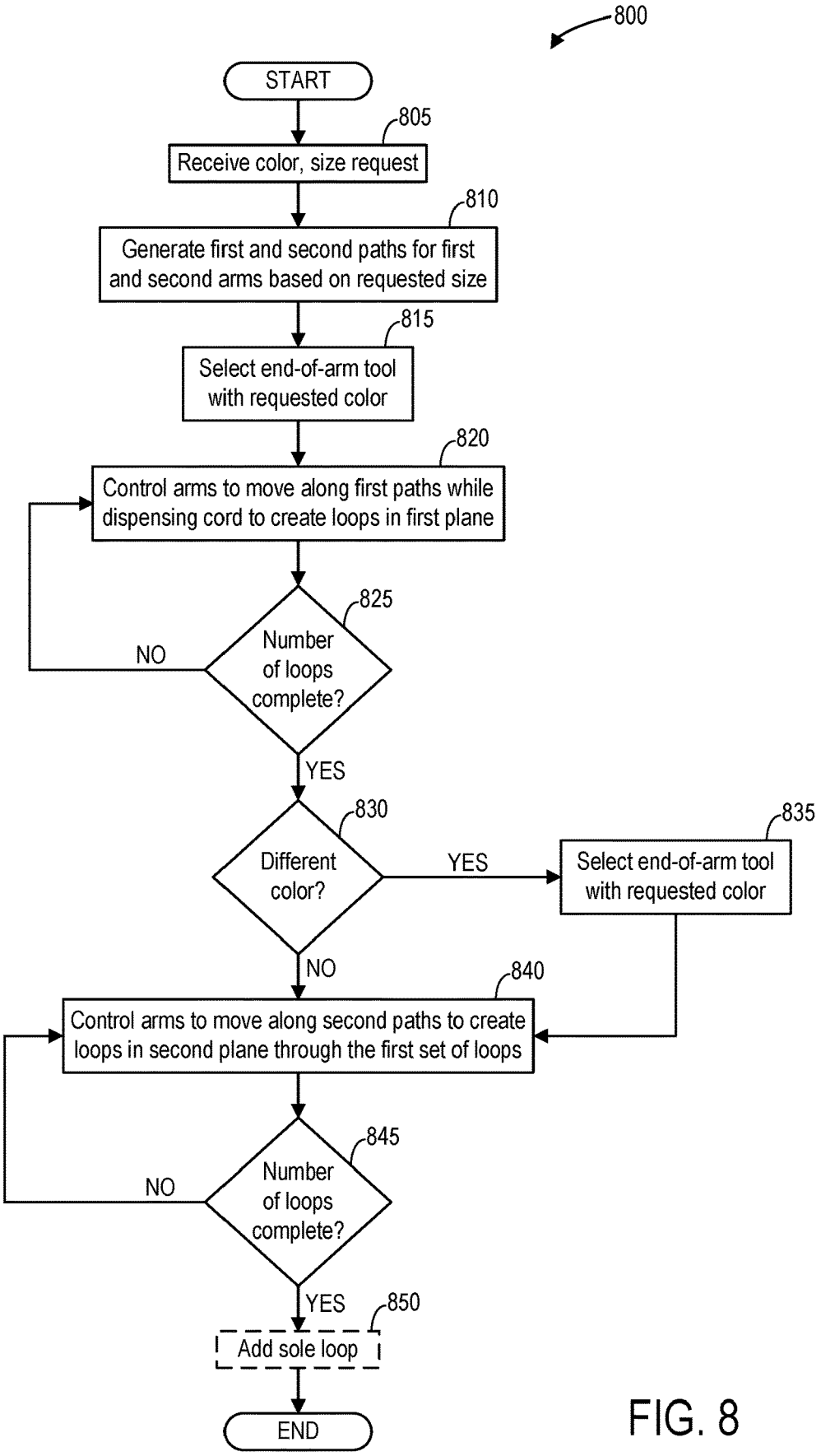
FIG. 8 shows a high-level flow chart illustrating an example method for automatically producing a cord structure.

FIG. 8 shows a high-level flow chart illustrating an example method 800 for automatically producing a cord structure. Method 800 relates to the control of a cordbuilding apparatus to construct a cord structure. Method 800 is described herein below with reference to the systems and components of FIGS. 3-6, though it should be understood that the method may be implemented with other systems and components without departing from the scope of the present disclosure. Method 800 may be carried out by a controller, such as controller 310, and may be stored as executable instructions 313 in non-transitory memory 312.

Method 800 begins at 805. At 805, method 800 includes receiving a color and a size request. The color request may include one or more colors for a cord structure. The size request may include a desired size of a cord structure. In embodiments wherein method 800 is directed to construction of a cord structure for a footwear article, the size request may comprise the desired shoe size. The color and size request may be received via a user interface of the cord-building apparatus, or may be received via communication with an external computing device.

At 810, method 800 includes automatically generating first and second paths for the first and second robotic arms based on the requested size. The first paths for the first and second robotic arms correspond to paths along which the first and second robotic arms operate to construct a first set of loops, while the second paths for the first and second robotic arms correspond to paths along which the first and second robotic arms operate to construct a second set of loops slippably engaged with the first set of loops. As an example, the paths may describe the desired position of each end-of-arm tool of the robotic arms, which may be positioned in three-dimensions within the cord-building apparatus. Therefore, each of the paths may be three-dimensional, and furthermore may include indications of where and/or when an end-of-arm tool may perform a specified function, such as actuating a solenoid. Thus, method 800 may also include generating setting instructions for the first and second robotic arms. Such setting instructions may also indicate to the first end-of-arm tool when to dispense cord, as the first end-of-arm tool may selectively rather than continuously dispense cord to form the loops.

At 815, method 800 includes automatically selecting an end-of-arm tool with the requested color. As a non-limiting example, the first robotic arm automatically procures the end-of-arm tool from the end-of-arm tool rack through which a cord with the desired color is threaded.

At 820, method 800 includes controlling the robotic arms to move along the first paths while dispensing cord to create loops in a first plane. Controlling the robotic arms to move along the first paths comprises commanding, via the controller, the first and the second arms to move along the first paths with the setting instructions generated at 810. The first path of the first robotic arm describes the path along which the first end-of-arm tool automatically dispenses cord through the end-of-arm tool, while the first path of the second robotic arm describes the path along which the second end-of-arm tool is positioned in order to hold the cord in place as the first end-of-arm tool dispenses the cord. The second end-of-arm tool thus functions, in part, as a temporary guidepost in free space as each loop is created.

The second end-of-arm tool may also automatically clamp the cord in selected places in order to temporarily maintain the structure of a loop while the first-end-of-arm tool is repositioned to create the next loop.

As an illustrative example, FIG. 9 depicts an example path 901 for the first end-of-arm tool which dispenses a cord 903 in a plane. The first end-of-arm tool begins at a position 911, and pulls a specified distance away from position 911 in a first direction 908 (e.g., the −x direction) towards a position 912 while dispensing the cord 903. The first end-of-arm tool then moves back towards position 911 in a second direction 909 (e.g., the +x direction) and continues a second specified distance away from position 911 towards position 913, all while dispensing the cord 903. The first end-of-arm tool then pulls back to position 912 in the first direction 909 (e.g., the −x direction) while also moving a distance 916 from the previous position 912 in a direction orthogonal to the pull-back motion, e.g., the +y direction as depicted in FIG. 9.

While positions 911 and 912 may be positioned on a loop fixture, typically the position 913 occurs in free space. To that end, the second end-of-arm tool may move between positions 911 and 913 to assist the first end-of-arm tool in creating the loops. This process is repeated for each loop.

Furthermore, the position 913 is located further away from position 911 than the desired loop size. That is, the cord 903 does not necessarily lie along the exact path 901 of the first end-of-arm tool. As depicted, although the path 901 of the first end-of-arm tool dispenses cord at position 913, the edge of the loop in cord 903 comes to rest at position 914, located in the x direction between positions 911 and 913. In other words, the first end of-arm tool dispenses cord a distance out in free space which is further than may be expected in order for the cord 903 to be positioned as depicted. That is, to create a loop which extends from position 912 to position 914, the first end-of-arm tool is commanded to dispense cord along a distance from position 912 to position 913, which is greater than the distance from position 912 to position 914.

It should be appreciated that the particular distances traveled by the first end of-arm tool may be determined based on the requested size of a footwear article or cord structure, which in turn may determine the appropriate size of each loop.

To further illustrate the construction of the first set of loops with the robotic arms, FIG. 10 illustrates an example construction 1000 of a first set of loops 1030 for a cord structure. The first set of loops 1030 are constructed in a first plane 1020, depicted as the x-y plane in FIG. 10 (with the z axis coming out of the page). The first end-of-arm tool 1005 is depicted as a triangle, while the second end-of-arm tool 1007 is depicted as a box. The first path 1010 depicted corresponds to the first path of the first robotic arm or the first end-of-arm tool 1005 which dispenses the cord 1009. The first end-of-arm tool 1005 constructs the first set of loops on the loop fixture 1001, and moves between the guideposts 1002 (depicted as small circles).

For the construction of a footwear article, an eyestay (not shown) may be positioned on the loop fixture 1001 such that the eyelets 1015 (depicted as ovals) align with the guideposts 1002 of the loop fixture 1001. The first end-of-arm tool 1005 moves along the first path 1010 and dispenses cord 1009 to create the first loops, while the second end of-arm tool 1007 moves along another first path (not shown) to assist the first end-of-arm tool 1005. As an example, the end-of-arm tool 1005 moves through the eyelet 1015 in a routine such as that depicted in FIG. 9, where the end-of-arm tool 1005 moves from a point B to a point C, through the eyelet 1015, and pulls back to point B through the same eyelet 1015. The length of the resulting loop is less than the distance that the first end-of-arm tool 1005 travels, as depicted and described above.

Further, as depicted, the construction of the loops is not limited to a single direction, but may wrap around in the first plane (e.g., the x-y plane).

Further still, it should be appreciated that in some examples, the cord may be dispensed by a first robotic arm through a hole in the sole material without being hooked by a second robotic arm. The sole material, which may comprise rubber and flashing as non-limiting examples, may be rigid and resistant to the cord, such that friction between the cord and the sole material captures the cord and holds it in place. In this way, the individual programming points of the first robotic arm may be reduced by approximately 500 points.

Referring again to FIG. 8, after the robotic arms create the first set of loops in the first plane, method 800 proceeds to 825. At 825, method 800 determines if the desired number of loops are complete. The desired number of loops may correspond to a selected size, and so method 800 may not continue until the desired number of loops in the first set of loops is complete. Thus, if the desired number of loops are not complete ("NO"), method 800 returns to 820. If the desired number of loops are complete ("YES"), method 800 proceeds to 830.

At 830, method 800 determines if a different color is requested for a second set of loops. If a different color is requested ("YES"), method 800 proceeds to 835. At 835, method 800 includes selecting an end-of-arm tool with the second requested color. Method 800 then proceeds to 840. If a different color is not requested ("NO"), method 800 proceeds directly to 840 and continues using the same end-of-arm tool selected at 815.

At 840, method 800 includes controlling the robotic arms to move along the second paths to create loops in a second plane orthogonal to the first plane through the first set of loops. While the first set of loops may be built using the guideposts of the loop fixture (and optionally, an eyestay including a plurality of eyelets through which the cord is dispensed, as described above), the second set of loops may be built using the first set of loops. As an illustrative example, the cord may be dispensed through each loop in the first set of loops similar to how the cord is dispensed through the eyelets with regard to the construction of the first set of loops.

As an illustrative example, FIG. 11 illustrates an example construction 1100 of a second set of loops 1130 through an already-constructed set of loops 1030, such as the first set of loops 1030 in FIG. 10. The second set of loops 1130 is constructed in a second plane 1120 (e.g., the x-z plane), which is orthogonal to the first plane 1020 (e.g., the x-y plane). The position of the first set of loops 1030 is depicted in perspective to illustrate how the cord 1109 is dispensed through the first set of loops 1030. The first end-of-arm tool 1105 (which may comprise the first end-of-arm tool 1005 depicted in FIG. 10, or may be a different end-of-arm tool with a different color thread, for example) moves along the second path 1110 of the first robotic arm. The second end-of-arm tool 1107 (which may comprise the second end-of-arm tool 1007 depicted in FIG. 10) moves along the second path (not shown) of the second robotic arm. Since the first set of loops 1030 extend beyond the loop fixture 1001 (as depicted in FIG. 10), the construction of the second set of loops 1130 may rely less on the loop fixture 1001 for guidance. That is, the second set of loops 1130 may be constructed entirely in free space. However, in examples wherein method 800 is directed towards constructing a corded upper, a sole 1117 may be positioned in the loop fixture as described herein above. The sole 1117 may include a plurality of slots 1115 through which the second set of loops may be woven. In such an example, the first end-of arm tool 1105 may dispense the cord 1109 through a loop of the first set of loops and then through a slot 1115 of the sole 1117, and then pull back through the same slot 1117 and through the same loop. The second end-of-arm tool 1107 may assist in holding the loop of the first set of loops or the newly constructed loop in place as the first end-of-arm tool dispenses the cord 1109.

As mentioned above, in some examples the friction between the sole 1117 and the cord 1109 may hold the cord 1109 in place once dispensed through the slot 1115, and so the second end-of-arm tool 1107 may not be necessary for holding the loop. In such examples, the pluralities of loops may be constructed entirely with the first robotic arm.

Though not depicted, the first end-of-arm tool may also extend a distance further than the desired length of the loop, as described herein above with regard to FIGS. 9 and 10. However, it should be appreciated that in some examples, the cord 1109 may lie exactly along the path 1110 along which the cord 1109 is dispensed.

Referring again to FIG. 8, after completing a loop in the second set of loops, method 800 continues to 845. At 845, method 800 determines if the desired number of loops is complete. If the desired number of loops is not complete ("NO"), method 800 returns to 840. If the desired number of loops is complete ("YES"), method 800 proceeds to 850.

At 850, method 800 optionally includes adding a sole or anchor loop to secure the cord structure. The sole or anchor loop may be woven through the loops under the sole (e.g., as depicted in FIG. 11) in order to secure the first and second set of loops to the sole. In some examples, 850 may be carried out manually by an operator of the cord-building apparatus. Method 800 then ends.

Thus, systems and methods are provided for the automatic construction of a cord structure. The cord structure may be integrated into or may comprise a footwear article, such as the footwear article depicted in FIG. 1. While the construction of a footwear article is described, such an embodiment is exemplary and non-limiting, and it should be appreciated that the methods and systems described herein may be applied to the construction of any cord structure. A system such as the system depicted in FIG. 3 which constructs cord structures by dispensing cord in three-dimensional space to form interlocking loops may thus be considered an additive manufacturing system.

In one embodiment, a method comprises automatically forming, with at least one robotic arm, a first plurality of loops in a first plane, and automatically forming, with the at least one robotic arm, a second plurality of loops in a second plane orthogonal to the first plane, the second plurality of loops slippably engaged with the first plurality of loops.

In a first example of the method, the at least one robotic arm comprises two or more robotic arms. In a second example of the method optionally including the first example, each loop of the first and second plurality of loops is formed by automatically controlling a first arm of the two or more robotic arms to dispense a cord from a first position to a second position in a first direction, and automatically controlling the first arm to dispense the cord from the second position to a third position in a second direction opposite to the first direction, wherein the first direction and the second direction are in one of the first and the second planes, and wherein a distance from the first position to the second position is less than a distance from the second position to the third position. In a third example of the method optionally including one or more of the first and second examples, the cord is automatically dispensed around a loop fixture post at the second position, and a second arm of the two or more robotic arms automatically holds the cord at the third position in free space. In a fourth example of the method optionally including one or more of the first through third examples, the first plurality of loops are automatically dispensed through an eyestay for a footwear article, the first plurality of loops comprising a vamp substructure of the footwear article. In a fifth example of the method optionally including one or more of the first through fourth examples, the second plurality of loops are automatically dispensed through a sole of the footwear article, the second plurality of loops comprising a rand substructure of the footwear article. In a sixth example of the method optionally including one or more of the first through fifth examples, the method further comprises automatically dispensing an anchor cord through the second plurality of loops on an exterior side of the sole. In a seventh example of the method optionally including one or more of the first through sixth examples, the first plurality of loops is dispensed along a face of a loop fixture. In an eighth example of the method optionally including one or more of the first through seventh examples, a first loop of the first plurality of loops is intertwined with and slidably movable relative to at least two loops of the second plurality of loops, and a second loop of the at least two loops is intertwined with and slidably movable relative to at least two loops of the first plurality of loops including the first loop.

In another embodiment, a system comprises: a loop fixture; at least two robotic arms including a first robotic arm configured to automatically dispense a cord; and a controller configured with instructions stored in non-transitory memory that when executed cause the controller to: control the at least two robotic arms to automatically dispense the cord to form a first plurality of loops on the loop fixture in a first plane; and control the at least two robotic arms to automatically dispense the cord to form a second plurality of loops in a second plane orthogonal to the first plane, the second plurality of loops slippably engaged with the first plurality of loops.

In a first example of the system, the controller is further configured with instructions in the non-transitory memory that when executed cause the controller to generate a first path for the first robotic arm, wherein controlling the at least two robotic arms to dispense the cord to form the first plurality of loops comprises controlling the first robotic arm to dispense the cord along the first path. In a second example of the system optionally including the first example, the cord comprises a first cord and a second cord, the first cord forming the first plurality of loops and the second cord forming the second plurality of loops. In a third example of the system optionally including one or more of the first and second examples, the controller is further configured with instructions in the nontransitory memory that when executed cause the controller to command the first robotic arm to select a first end-of-arm tool prepared with the first cord prior to forming the first plurality of loops, and to command the first robotic arm to select a second end-of-arm tool prepared with the second cord prior to forming the second plurality of loops. In a fourth example of the system optionally including one or more of the first through third examples, the first end-of-arm tool and the second end-of-arm tool are stored in a rack positioned adjacent to the first robotic arm. In a fifth example of the system optionally including one or more of the first through fourth examples, a second robotic arm of the at least two robotic arms includes an end-of-arm tool configured to hold the cord in selective positions as the first robotic arm dispenses the cord to form the first and second plurality of loops. In a sixth example of the system optionally including one or more of the first through fifth examples, an eyestay and a sole are positioned on the loop fixture, and wherein the first plurality of loops is dispensed through the eyestay and the second plurality of loops is dispensed through the sole to form a footwear article. In a seventh example of the system optionally including one or more of the first through sixth examples, a size of each loop in the first and second pluralities of loops are determined based on a size of the footwear article.

In yet another embodiment, a system comprises a robotic arm, and a controller communicatively coupled to the robotic arm and configured with instructions in nontransitory memory that when executed cause the controller to: control the robotic arm to dispense a first cord to form a first plurality of loops in a first plane, wherein at least one loop of the first plurality of loops is dispensed at least partially into a sole; and control the robotic arm to dispense a second cord to form a second plurality of loops in a second plane orthogonal to the first plane, the second plurality of loops slippably engaged with the first plurality of loops.

In a first example of the system, the sole comprises at least one material, and friction between the at least one material and the at least one loop holds the at least one loop in place. In a second example of the system optionally including the first example, a first loop of the first plurality of loops is intertwined with and slidably movable relative to at least two loops of the second plurality of loops, and a second loop of the at least two loops is intertwined with and slidably movable relative to at least two loops of the first plurality of loops including the first loop. In a third example of the system optionally including one or more of the first and second examples, the system further comprises an end-of-arm tool coupled to an end of the robotic arm, the end-of-arm tool configured to dispense at least one of the first cord and the second cord.

In another representation, a method comprises: forming, with two or more robotic arms, a first plurality of loops in a first plane; and forming, with the two or more robotic arms, a second plurality of loops in a second plane orthogonal to the first plane, the second plurality of loops slippably engaged with the first plurality of loops. In one example of the method, each loop of the first and second plurality of loops is formed by controlling a first arm of the two or more robotic arms to pull a cord from a first position to a second position in a first direction, and controlling the first arm to pull the cord from the second position to a third position in a second direction opposite to the first direction, wherein the first direction and the second direction are in one of the first and the second planes, and wherein a distance from the first position to the second position is less than a distance from the second position to the third position. In a second example of the method, the cord is pulled around a loop fixture post at the second position, and wherein a second arm of the two or more robotic arms holds the cord at the third position in free space.

In yet another representation, a system comprises: a loop fixture; at least two robotic arms; a controller with instructions stored in non-transitory memory that when executed cause the controller to: control the at least two robotic arms to form a first plurality of loops on the loop fixture in a first plane; and control the at least two robotic arms to form a second plurality of loops in a second plane orthogonal to the first plane, the second plurality of loops slippably engaged with the first plurality of loops.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and sub-combinations of the various features, functions, acts, and/or properties disclosed herein, as well as any and all equivalents thereof.

The invention claimed is:

1. A method, comprising:

automatically forming, with at least one robotic arm, a first plurality of loops in a first plane, wherein the first plurality of loops is automatically dispensed through an eyestay for a footwear article, the first plurality of loops comprising a vamp substructure of the footwear article; and automatically forming, with the at least one robotic arm, a second plurality of loops in a second plane orthogonal to the first plane, the second plurality of loops slippably engaged with the first plurality of loops, wherein the second plurality of loops is automatically dispensed through a sole of the footwear article, the second plurality of loops comprising a rand substructure of the footwear article.

2. The method of claim 1, wherein the at least one robotic arm comprises two or more robotic arms.

3. The method of claim 1, wherein each loop of the first and second plurality of loops is formed by automatically controlling a first arm of the two or more robotic arms to dispense a cord from a first position to a second position in a first direction, and automatically controlling the first arm to dispense the cord from the second position to a third position in a second direction opposite to the first direction, wherein the first direction and the second direction are in one of the first and the second planes, and wherein a distance from the first position to the second position is less than a distance from the second position to the third position.

4. The method of claim 1, wherein the cord is automatically dispensed around a loop fixture post at the second position, and wherein a second arm of the two or more robotic arms automatically holds the cord at the third position in free space.

5. The method of claim 1, further comprising automatically dispensing an anchor cord through the second plurality of loops on an exterior side of the sole.

6. The method of claim 1, wherein a first loop of the first plurality of loops is intertwined with and slidably movable relative to at least two loops of the second plurality of loops, and wherein a second loop of the at least two loops is intertwined with and slidably movable relative to at least two loops of the first plurality of loops including the first loop.

7. A method of manufacturing footwear using a two robotic arms, the method comprising:

controlling the at least two robotic arms to automatically dispense a cord to form a first plurality of loops on a loop fixture in a first plane;

controlling the at least two robotic arms to automatically dispense the cord to form a second plurality of loops in a second plane orthogonal to the first plane, the second plurality of loops slippably engaged with the first plurality of loops, wherein an eyestay and a sole are positioned on the loop fixture; and dispensing the first plurality of loops through the eyestay and dispensing the second plurality of loops through the sole to form a footwear article.

8. The method of claim 7, further comprising controlling the at least two robotic arms to dispense the cord to form the first plurality of loops comprises controlling the first robotic arm to dispense the cord along a first path.

9. The method of claim 7, wherein the cord comprises a first cord and a second cord, the first cord forming the first plurality of loops and the second cord forming the second plurality of loops.

10. The method of claim 9, further comprising commanding the first robotic arm to select a first end-of-arm tool prepared with the first cord prior to forming the first plurality of loops, and commanding the first robotic arm to select a second end-of-arm tool prepared with the second cord prior to forming the second plurality of loops.

11. The method of claim 10, storing the first end-of-arm tool and the second end-of-arm tool in a rack positioned adjacent to the first robotic arm.

12. The method of claim 7, further comprising determining a size of each loop in the first and second pluralities of loops based on a size of the footwear article.

13. A method comprising:

controlling a robotic arm to dispense a first cord to form a first plurality of loops on a loop fixture in a first plane, wherein an eyestay and a sole are positioned on the loop fixture, and wherein the first plurality of loops is dispensed through the sole; and controlling a robotic arm to dispense a second cord to form a second plurality of loops in a second plane orthogonal to the first plane, the second plurality of loops slippably engaged with the first plurality of loops and dispensed through the eyestay to form a footwear article.

14. The method of claim 13, wherein the sole comprises at least one material, and wherein friction between the at least one material and the first plurality of loops holds the first plurality of loops in place.

15. The method of claim 13, further comprising intertwining a first loop of the first plurality of loops with where the first loop is slidably movable relative to at least two loops of the second plurality of loops, and intertwining a second loop of the at least two loops where the second loop is slidably movable relative to at least two loops of the first plurality of loops including the first loop.

16. The method of claim 13, further comprising dispensing from an end-of-arm tool coupled to an end of the robotic arm at least one of the first cord and the second cord.

* * * * *